United States Patent [19]

Schlicker, Jr.

[11] 4,454,921

[45] Jun. 19, 1984

[54] REPLACEABLE BLADE FOR CABLE LAYING PLOW

[76] Inventor: Harold R. Schlicker, Jr., 18012 Bothell Hwy., Bothell, Wash. 98011

[21] Appl. No.: 282,373

[22] Filed: Jul. 13, 1981

[51] Int. Cl.[3] ..... A01B 13/08; A01B 15/02

[52] U.S. Cl. ..... 172/699; 172/753; 172/772.5

[58] Field of Search ..... 172/753, 749, 750, 751, 172/719, 767, 699; 37/141 R

[56] References Cited

U.S. PATENT DOCUMENTS

| | | | |
|---|---|---|---|
| 323,770 | 8/1885 | Zeek | 172/752 |
| 796,225 | 8/1905 | Klingberg | 172/763 |
| 970,818 | 9/1910 | Harryman | 37/193 |
| 1,294,434 | 2/1919 | Farrell | 172/753 |
| 1,351,376 | 8/1920 | Dillon | 172/752 |
| 1,358,584 | 11/1920 | Schenk | 172/753 |
| 1,668,277 | 5/1928 | Kirby . | |
| 3,001,591 | 9/1961 | Johnson | 172/753 X |
| 3,170,300 | 2/1965 | Kelley | 61/72.6 |
| 3,202,222 | 8/1965 | Norris | 172/719 |
| 3,341,253 | 9/1967 | Hostetter | 299/10 |
| 3,497,016 | 2/1970 | Ryan | 172/40 |
| 3,777,500 | 12/1973 | Kelley | 61/72.6 |
| 3,912,020 | 10/1975 | Rockwell | 172/719 |
| 4,085,530 | 4/1978 | Landry | 172/719 |
| 4,142,817 | 3/1979 | Lazure | 405/174 |

*Primary Examiner*—Richard J. Johnson
*Attorney, Agent, or Firm*—Delbert J. Barnard

[57] ABSTRACT

A replaceable blade adapted to be secured in a shank supported in a cable laying plow. The blade has an elongated leading edge and has an elongated trailing spline to be fitted in a slot in the shank. The spline and leading edge of the blade are spaced transversely to the elongated direction. There are extensions at the end of the spline and end of the slot. The elongated portion of the spline is secured to the shank on the plow by split sleeves through respective bores in the shank and spline. The extension on the spline which extends above the blade and is received by the extension in the slot is secured by an additional sleeve to provide additional support of the blade in the shank against forces that would tend to create moments and cause rotation about the elongated portion of the spline in the elongated portion of the shank slot.

6 Claims, 6 Drawing Figures

REPLACEABLE BLADE FOR CABLE LAYING PLOW

TECHNICAL FIELD

The invention relates to cable laying plows and to replaceable blades therefor.

BACKGROUND ART

Some of the prior art cable laying plow blades have no replaceable cutting edges and when the edges are dulled the blades have to be disgarded or rebuilt.

Some of the prior art plows were provided with replaceable sharp edge members, but they typically were made in expensive-to-machine configurations and were adapted to fit over the permanent blade fixtures. A search of the patent literature discloses a number of such replaceable blades. For example, U.S. Pat. No. 3,170,300 to Kelley, illustrates a replaceable blade 66 which fits over the plow shank. Replaceable blade 66 is generally V-shaped, having four external surfaces. Such a configuration requires substantial expensive machining and is therefore impractical from an economical point of view. Similarly shaped replaceable blades are shown in U.S. Pat. No. 3,497,016; U.S. Pat. No. 3,341,253; and U.S. Pat. No. 3,377,500.

The following patents disclose blades and/or replacements less pertinent to the present invention than those described above:

U.S. Pat. No. 4,142,817, Lazure
U.S. Pat. No. 1,668,277, Kirby
U.S. Pat. No. 1,351,376, Dillon
U.S. Pat. No. 970,818, Harryman
U.S. Pat. No. 796,225, Klingberg
U.S. Pat. No. 323,770, Zeek

DISCLOSURE OF THE INVENTION

The invention is a replaceable blade for a cable laying plow and the combination of the blade and the plow. The replaceable blade, according to the invention, is made of a very hard and brittle steel alloy so as to provide long life.

The blade is a relatively narrow body substantially elongated with respect to its width and has a thin leading cutting edge, tapering upwardly from its bottom end. The blade body has a thickened portion at its trailing end, the body tapering from the trailing end to the leading edge. In cross section the blade body is substantially triangular. Extending from the trailing end of the body is an elongated spline, substantially rectangular in cross section, having a thickness about ⅓ that of the thickest part of the triangular body.

The spline is elongated and extends for the same length as the blade body. At the upper end of the spline, there is an extension so as to form the foot of an L on the spline, the spline being an elongated leg portion of the L. The foot has curved portions between the spline and the end of the foot which extends over the blade body so that the leading edge of the blade is in substantial alignment with a leading surface on the end of the foot.

The spline has a series of spaced bores therethrough and the extension also has such a bore. The bore through the extension is positioned so as to be above the blade body in the elongated direction and in the direction transverse to the elongated direction between the trailing end of the blade body and the leading edge of the blade.

The spline and its extension are adapted to fit within a complementary shank slot. The shank has corresponding bores to those in the spline and the spline extension. The spline and the replaceable blade are secured in the shank by split sleeves, press fit into the respective bores.

The present invention is a considerable improvement in contrast to the replaceable blades shown in the prior art in that it has a configuration which is relatively inexpensive to manufacture. In addition, the extension at the end of the spline provides a structural configuration within the shank to eliminate the effect of forces developed during operation on the blade body that would tend to rotate the spline within the shank slot. It has been found that by merely extending the spline, to have a portion thereof above the blade body, adds very substantial structural strength to the blade as it is held within the shank. Without the extension according to the invention, the spline within the shank slot has considerably less holding force than with the inventive extension and is subject to the effects of cross forces which tend to create moments against the blade so as to tend to cause it to rotate with respect to the shank and slot in which it is secured.

As the replaceable blade eventually wears, it is easily removed and replaced in the shank according to the invention.

Further advantages of the invention may be brought out in the following part of the specification, wherein small details have been described for the competence of the disclosure, without intending to limit the scope of the invention which is set forth in the appended claims.

BRIEF DESCRIPTION OF THE DRAWINGS

Referring to the accompanying drawings which are for illustrative purposes.

BEST MODE OF THE INVENTION

Figure 1:
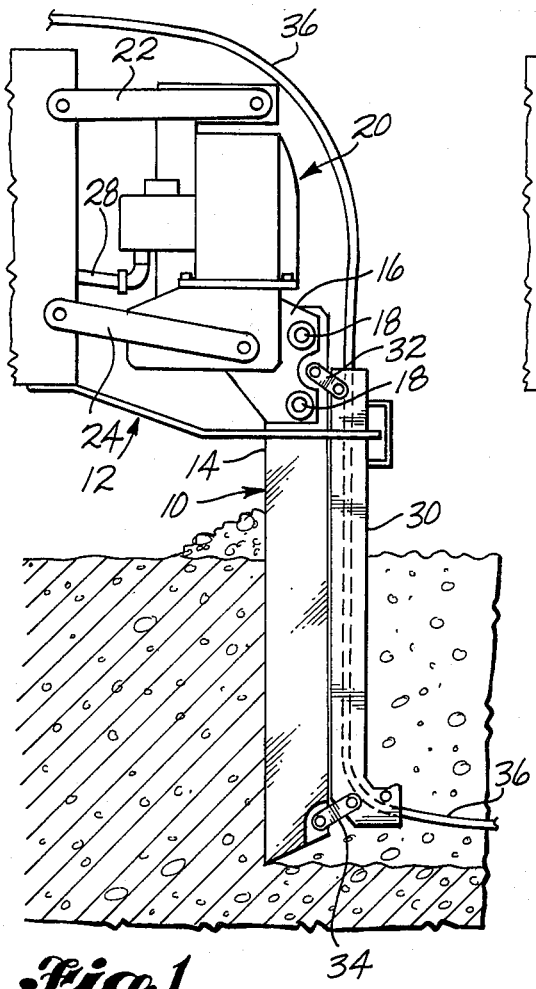
Fig. 1 PRIOR ART
FIG. 1 is a fragmentary side elevational view of a cable laying plow illustrating a prior art blade.

Referring again to the drawings, there is shown in FIG. 1 a cable laying plow, having a single piece prior art blade, generally designated as 10. The blade 10 is supported on the rear end of a plow structure 12 for forwardly cutting movement in the soil in the direction to the left in the drawing. The blade has a leading, sharp cutting edge 14 and is secured at its upper end between a pair of plates 16 by means of bolts 18. Plates 16 are supported by a hydraulic or pneumatically operated oscillating device, generally designated as 20, the oscillating structure being supported by beams 22 and 24 having one end pivotally engaged with a forward portion of the plow frame and having their rearward ends connected to the oscillating device 20. During oscillation, the pneumatic or hydraulic power source supplies fluid through the tube 28, so as to reciprocate the structure 20 upwardly and downwardly and thereby oscillate the blade 10 in the soil to produce a forwardly moving cutting action to create a furrow for the cable.

Attached to the trailing end of the blade is a cable feeding sleeve 30, fixed to oscillate and move forwardly with the blade by means of a plurality of beams 32 and 34. A cable 36, is fed into the sleeve 30 from a drum, not shown, and is laid in the furrow cut into the soil by the blade as it moves forwardly and the cable moves out of the sleeve 30.

A prior art blade such as 10 suffers substantial wear as it is moves through the soil where it engages rocks and possible other obstructions. Where it is worn or dulled significantly, it must be replaced in its entirety and either must be discarded or rebuilt.

Figure 2:
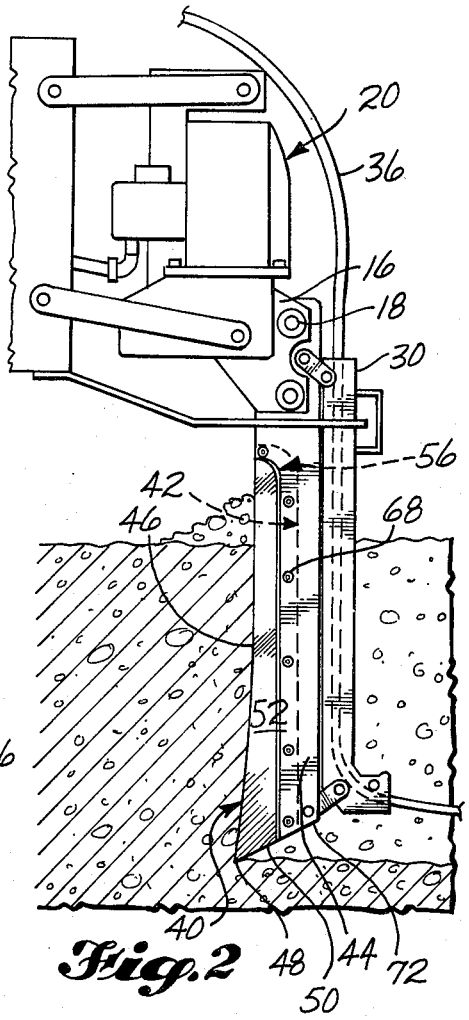
FIG. 2 is a view similar to FIG. 1, illustrating the present invention.
Figure 3:
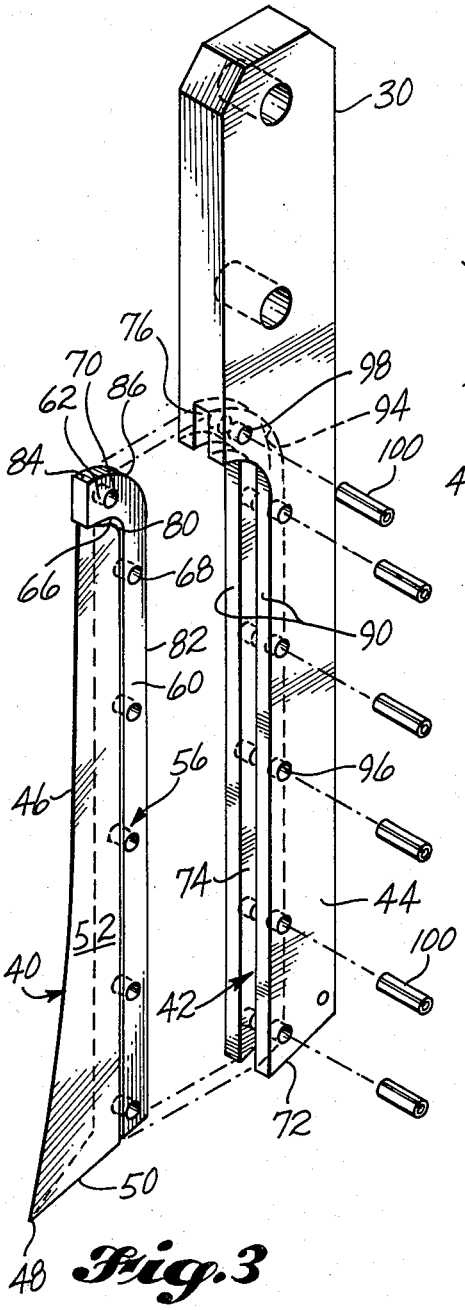
FIG. 3 is an exploded pictorial view, illustrating the blade and shank of the present invention.
Figure 4:
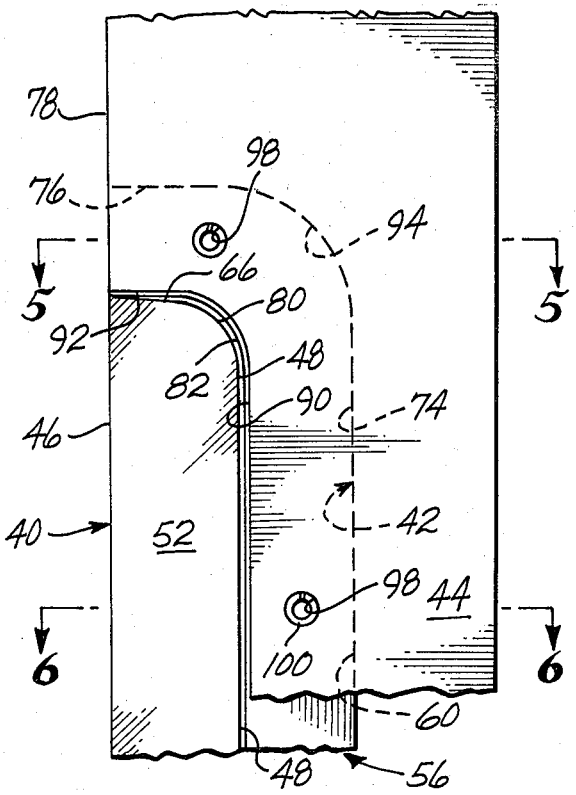
FIG. 4 is a fragmentary enlarged elevational view, illustrating the blade secured in the shank.
Figure 5:
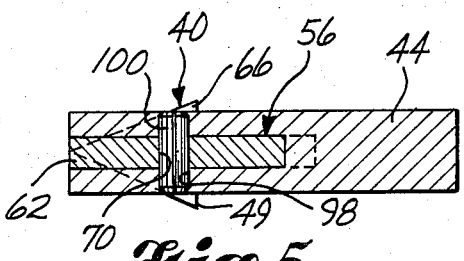
FIG. 5 is a cross-sectional view taken along the line 5—5 in FIG. 4.
Figure 6:
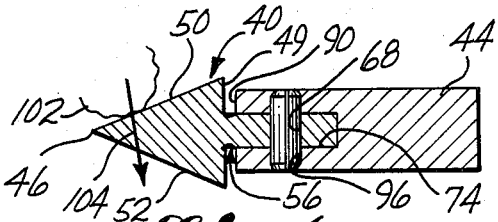
FIG. 6 is a cross-sectional view taken along the line 6—6 in FIG. 4.

In FIG. 2, the same plow and cable feeding sleeve is shown as in FIG. 1. Here, a blade generally, designated as 40, is secured within a slot generally, designated as 42, in a blade shank 44 having its upper end secured to the plates 16 by means of bolts 18 in the same manner as shown in FIG. 1.

The blade 40, has a leading sharp edge 46 which tapers upwardly in the elongated direction from a lower pointed end 48. The bottom end of the blade 50, trails upwardly to be adjacent the lower end of the slot 42. In plan view, the blade 40 is generally triangular, having a trailing base portion 49 from which varying length sides 50 and 52, FIGS. 3–6.

Trailing from the base portion, is a taper spline, generally designated as 56. The spline 56 in plan view, FIG. 6, has a thickness equal to about ⅓ of the width of the blade along the surface 49, the spline being generally rectangular. The spline extends in the elongated direction along the trailing end of the blade to form a leg 60 and has an extension 62 beyond the blade in the elongated direction, and transversely to the elongated direction over the blade, forming an L-shaped foot on the L leg 60. The transverse extension 62 extends directly over an upper end 66 of the blade with no space between the extension and the end of the blade, the surface 66 extending horizontally beyond the lower end of the extension a small amount, FIGS. 3 and 5.

The elongated portion 60 of the spline has a plurality of generally vertically, aligned spaced bores 68 and the extension 62 has a similar bore 70 having its axis parallel to the axes of the bores 68. The bore 70, is directly above the blade and it is spaced between imaginary continuations of the blade edge 46 and the trailing surface 49 of the blade.

The shank 44 has a lower tapered end 72, adapted to be in alignment with the tapered ends of the blade and the spline. The slot 42 has an elongated portion 74, generally channel shaped within the shank and has a rectangular configuration adapted to easily but snugly receive the elongated portion 60 of the spline 56. At the upper end of the slot 42, there is an extension 76, vertically above the elongated portion 74 and transversely with respect to the elongated direction of leading edge 78 of the shank, the shank being cut away outwardly of the slot portion 74 to receive the blade 40.

Between the elongated surface 49 and the transverse surface 66 of the blade, there is a curved joining surface 80. The trailing edge 82 of the spline is joined to outer transverse extension surface 84 by a curved portion 86. In the same manner, elongated edges 90 of the shank are curved at their upper edges where they extend into transverse edges 92. Complementary to the surface 86, the slot has a curved surface 94, so that the extension of the spline may be easily fitted therein.

Corresponding to the bores 68 and the bore 70 in the spline, there are bores 96 and 98, respectively, through both walls of the shank forming the slot. The blade and spline are secured to the shank by split sleeves 100, which are press fit into the bores 96 and 98 in the shank and the corresponding bores 68 and 70 in the spline, FIGS. 3–6. The sleeves are made to be oversized with respect to the bores, and when they are pressed therein, the splits are diminished in width.

The sleeves in the bores in the elongated portions of the spline, are generally adequate to support the blade in the shank. However, it has been found, according to the invention, that the additional structure provided by the extension 62 on the spline and the extension 76 in the slot with the additional sleeve through the bores 98 and 70 provide a very substantial supporting means to eliminate the effect of side forces on the blade, such as indicated by the rock structure 102 and its force, indicated by the arrow 104. That is, such a force against a plow blade tends to cause a rotation about the elongated axis through the sleeves and bores spaced only in the elongated direction, but the addition of the extensions and the additional split sleeve for practical purposes add substantial additional holding strength to avoid the damaging effects of such forces. This added structure thereby provides a substantially longer life for the replaceable blade, such as 40 within the shank.

The invention and its attendant advantages will be understood from the foregoing description and it will be apparent that various changes can be made in the form, construction, and arrangements of the parts of the invention without departing from the spirit and scope thereof or sacrificing its material advantages, the arrangements hereinbefore described being merely by way of example. I do not wish to be restricted to the specific forms shown or uses mentioned, except as defined in the accompanying claims.

I claim:

1. In a cable laying plow, the improvement comprising:

a vertically elongated, upper end mounted, blade supporting shank having parallel sides, a leading edge and a trailing edge, and a lower end, said leading edge including a forwardly opening slot;

said mounting slot comprising a vertical major portion extending downwardly to the lower end of the shank and an upper end minor portion which extends forwardly from the vertical major portion;

said mounting slot being formed by sidewalls, said sidewalls including a vertical row of axially aligned pairs of transverse fastener openings where they form the vertical major portion of the slot, and at least one axially aligned pair of transverse fastener openings whereat they form the upper end minor portion of the slot, spaced forwardly of the vertical row of pairs of fastener openings;

an elongated replaceable blade member having a forward blade portion with upper and lower ends, and a rearward mounting spline;

said mounting spline being sized to be snugly received within the forward edge slot in the mounting shank, and including an upper end portion which extends forwardly over the upper end of the blade portion, and which is received in the upper end minor portion of said slot;

said blade portion having a leading edge, a base whereat said blade portion joins the mounting spline, and side surfaces which divert apart as they extend rearwardly from the leading edge to the base, said base being wider than the mounting shank;

said lower end of said blade portion extending below the lower end of the mounting shank;

said mounting spline including transverse fastener openings corresponding in number and spacing to the fastener openings in the slot forming sidewalls of the supporting shank; and fastener elements extendable through the transverse openings in the slot forming sidewalls of the supporting shank and the corresponding transverse openings in the mounting spline of the replaceable blade member, for connecting the replaceable blade member to the supporting shank.

2. The improvement of claim 1, wherein the fastener elements each have a length substantially equal to the thickness of the mounting shank.

3. The improvement of claim 2, wherein the fastener elements are expanded split sleeves.

4. The improvement of claim 1, wherein the fastener elements are expanded split sleeves.

5. The improvement of claim 1, wherein the leading edge of the blade portion of the blade member extends forwardly as it extends downwardly in at least the lower portion of the blade member.

6. The improvement of claim 1, wherein the lower end of the blade portion of the blade member slopes downwardly from the base to the leading edge.

* * * * *